US008295999B2

(12) United States Patent
Groves et al.

(10) Patent No.: US 8,295,999 B2
(45) Date of Patent: Oct. 23, 2012

(54) SYSTEM AND METHOD FOR THE AUTOMATIC GENERATION OF MOVEMENT AUTHORITY SOLUTIONS IN A RAIL SYSTEM

(75) Inventors: Blaine R. Groves, Manassas, VA (US); Richard A. Allshouse, Manassas, VA (US)

(73) Assignee: Lockheed Martin Corp., Bethesda, MD (US)

( * ) Notice: Subject to any disclaimer, the term of this patent is extended or adjusted under 35 U.S.C. 154(b) by 165 days.

(21) Appl. No.: 12/845,692

(22) Filed: Jul. 28, 2010

(65) Prior Publication Data

US 2011/0035083 A1 Feb. 10, 2011

Related U.S. Application Data

(60) Provisional application No. 61/231,680, filed on Aug. 6, 2009.

(51) Int. Cl.

| | |
|---|---|
| ***G05D 1/00*** | (2006.01) |
| ***G05D 3/00*** | (2006.01) |
| ***G06F 7/00*** | (2006.01) |
| ***G06F 17/00*** | (2006.01) |

(52) U.S. Cl. ..... 701/19; 701/410; 701/416; 701/423; 701/482; 246/2 R; 246/3

(58) Field of Classification Search ..... 701/19, 701/410, 423, 416, 482; 246/2 R, 3
See application file for complete search history.

(56) References Cited

U.S. PATENT DOCUMENTS 5,751,569 A * 5/1998 Metel et al. ..... 700/3
6,459,964 B1 * 10/2002 Vu et al. ..... 701/19

* cited by examiner

*Primary Examiner* — Thomas Tarcza
*Assistant Examiner* — Kevin Myhre
(74) *Attorney, Agent, or Firm* — Wallace G. Walter

(57) ABSTRACT

A dual-process system for the automatic generation of railway route-solution candidates and their concomitant movement authorities includes a central authority server that accepts dispatcher-provided start and end point data and time information and executes two different independent routing processes to provide two independently determined route-solution candidates. The two solutions are compared for consistency and, when consistent, the route with the minimum authority grants is selected as the solution for use by the locomotive or train.

6 Claims, 6 Drawing Sheets

SYSTEM AND METHOD FOR THE AUTOMATIC GENERATION OF MOVEMENT AUTHORITY SOLUTIONS IN A RAIL SYSTEM

CROSS-REFERENCE TO RELATED APPLICATION

This application claims the benefit of U.S. Provisional patent application 61/231,680 filed Aug. 6, 2009 by the applicants herein, the disclosure of which is incorporated herein by reference.

BACKGROUND

The present invention relates to systems and method for routing of locomotives and locomotive consists from a start point to an endpoint in a track system and, more particularly, to such systems and methods for defining or arranging an authorized route through a track system as a function of at least two different routing processes.

SUMMARY

A dual process system for the automatic generation of movement authority solutions between a start point and end point in a rail system accepts dispatcher-provided endpoints and time data and, optionally, one or more midpoints to ensure a particular route. A central authority server executes two different independent routing processes to provide two independently determined routing authority candidate solutions; the two solutions are compared for consistency and, when consistent, the route with the minimum authority grants is selected as the solution for use by the locomotive or train.

One of the two independent routing processes utilizes a train-centric process in which each locomotive, train, switch, etc. is represented by an independent object within the central authority server with software functioning to "look ahead" along a route from the start point to the end point and effect a conflict check with trackside devices (i.e., switches) and with other locomotives or trains to assure the absence of route conflicts. In the event this "look ahead" processes encounters a conflict, movement authority is truncated so that the train can never enter an unsafe location. Each location update, switch change, or authority grant/rollup causes a re-evaluation of the entire forward route to determine if the authority can be extended, must be truncated, or remain as-is.

The second of the two different processes utilizes a network simulator that evaluates the entire train network and identifies any safe authority limitations from a network-centric perspective. The network simulator accepts the same dispatcher-provided endpoints and time data as the train-centric process, but utilizes algorithms based on a top-down evaluation to arrive at a routing solution candidate and the concomitant authorities via a conceptually different pathway.

The solutions provided by both processes are compared for consistency and, when consistent (i.e., essentially identical), an authority grant is issued. Where inconsistent and based upon the safeworking rules of the railroad, the entire authority can truncated to allow the train dispatcher to manually address or rectify any real or psuedo-real error or conflict. For example, where the applicable safeworking rules require an identity between the two solutions, the authority request would be referred to the dispatcher for resolution. As another example, the "least permissive authority" can be issued for the starting location to the point where the solutions differ or become inconsistent.

The system decreases safety issues associated with human error and reduces the workload of the dispatchers.

DESCRIPTION OF THE PREFERRED EMBODIMENTS

Figure 1:
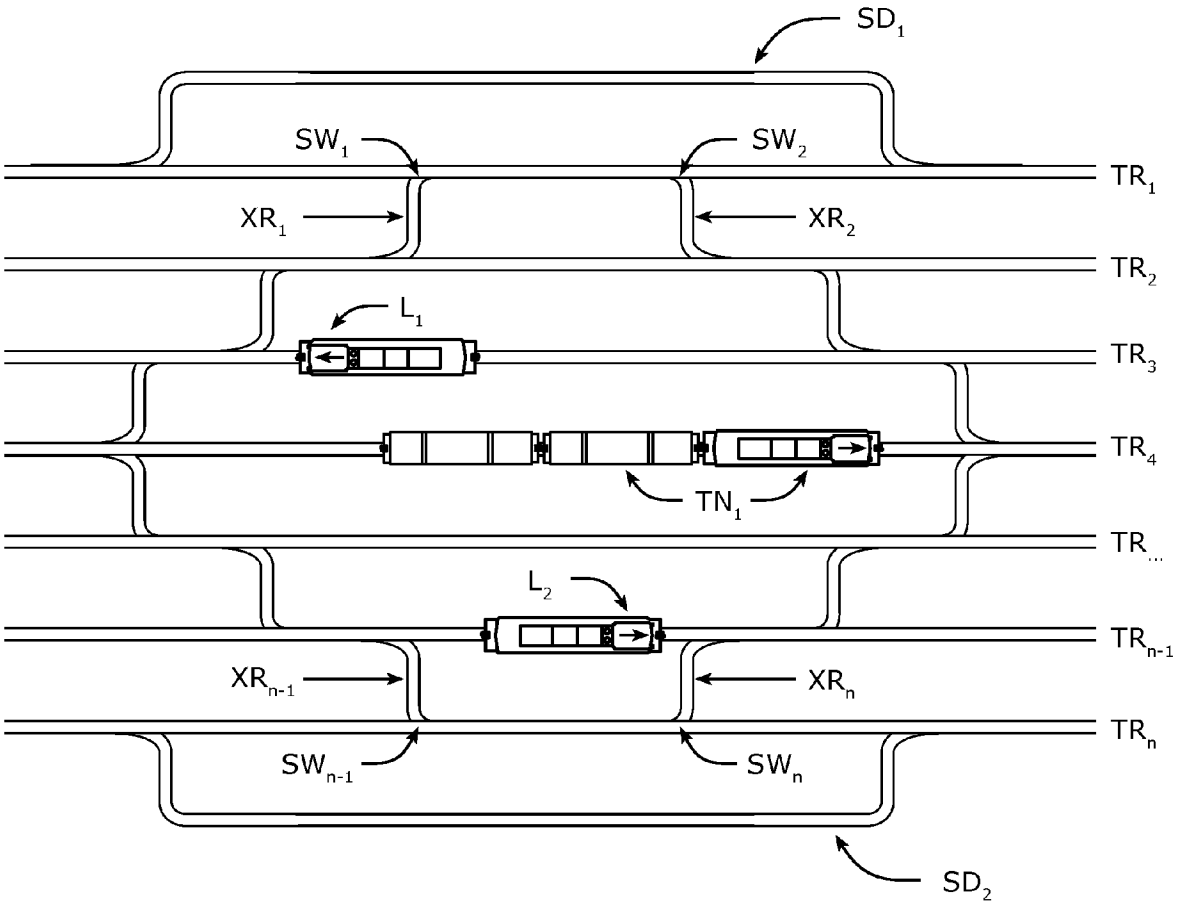
FIG. 1 is an idealized example of a track system having switches, locomotives, and trains.

FIG. 1 is a representative or schematic presentation of a rail system for the purpose of illustrating the preferred embodiment. As shown therein, a rail system can include a plurality of tracks $TR_1$, $TR_2$, . . . , $TR_3$, $TR_{n-1}$, $TR_n$ representing different possible routing pathways, a plurality of switches $SW_1$, $SW_2$, . . . , $SW_3$, $SW_{n-1}$, $SW_n$ connecting various of the trackways via cross-overs $XR_1$, $XR_2$, . . . , $XR_3$, $XR_{n-1}$, $XR_n$ and track sidings $SD_1$, $SD_2$, . . . , $SD_3$, $SD_{n-1}$, $SD_n$. Locomotives, as represented at $L_1$ and $L_2$, and trains, as represented at $TN_1$, can move through the system along various of the tracks $TR_n$, through various of the switches $SW_n$, and along various of the cross-overs $XR_n$, and/or sidings $SD_n$. While not specifically shown, other components within a rail system can include various types of open/close rail bridges, etc.

In order for a locomotive or train to move from a start point to an end point, a dispatcher must enter start and end points and times (and, optionally, one or more mid-points) into a central office server which then grants various "authorities" to assure that a segment of track, a switch or switches, etc. are available for that locomotive or train and which authorities also do not conflict or overlap with authorities issued for other locomotives or trains moving through the system.

Figure 2A:
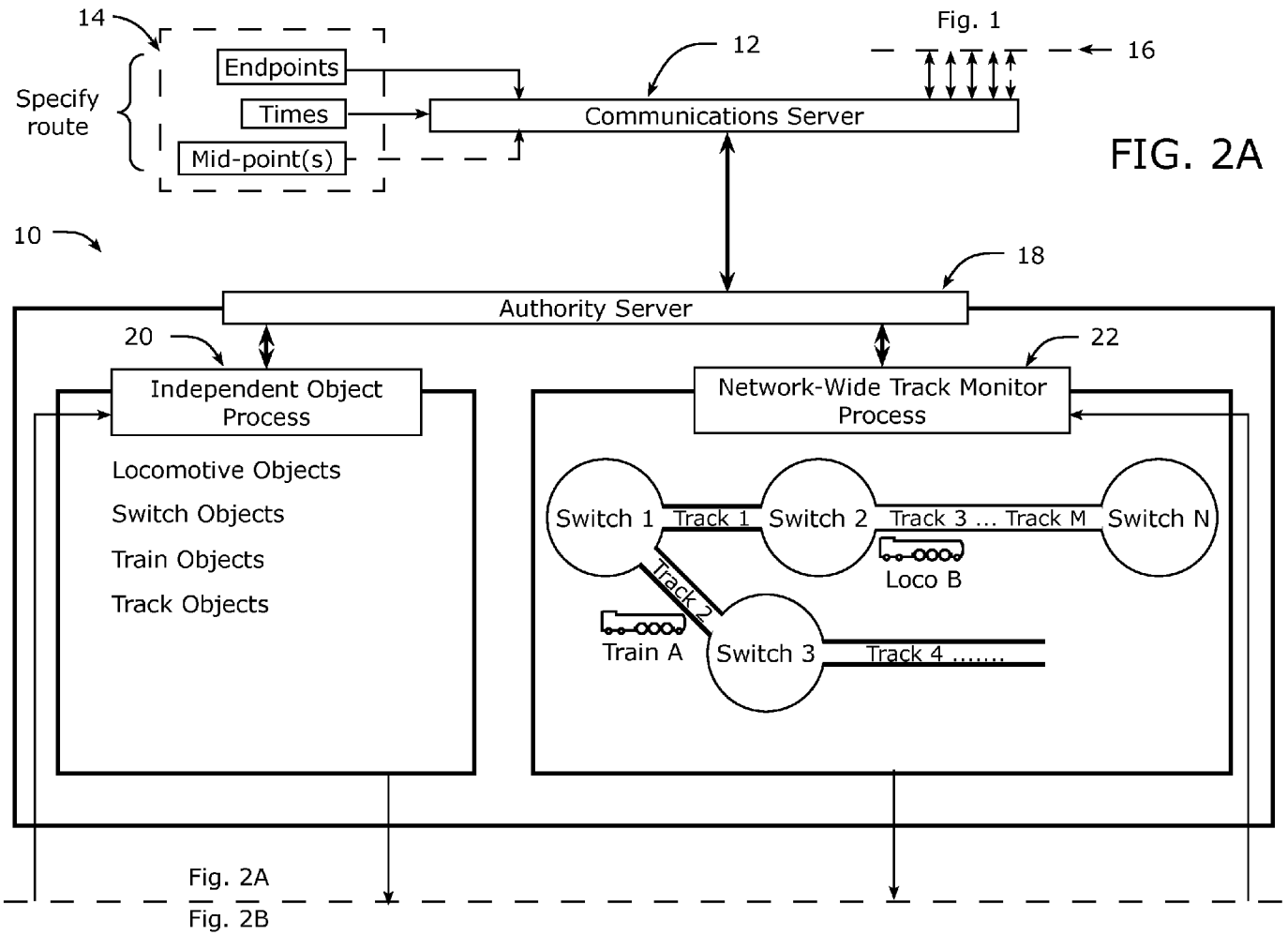
FIGS. 2A-2B are an overall process/flow chart illustrating the dual-process system.
Figure 2B:
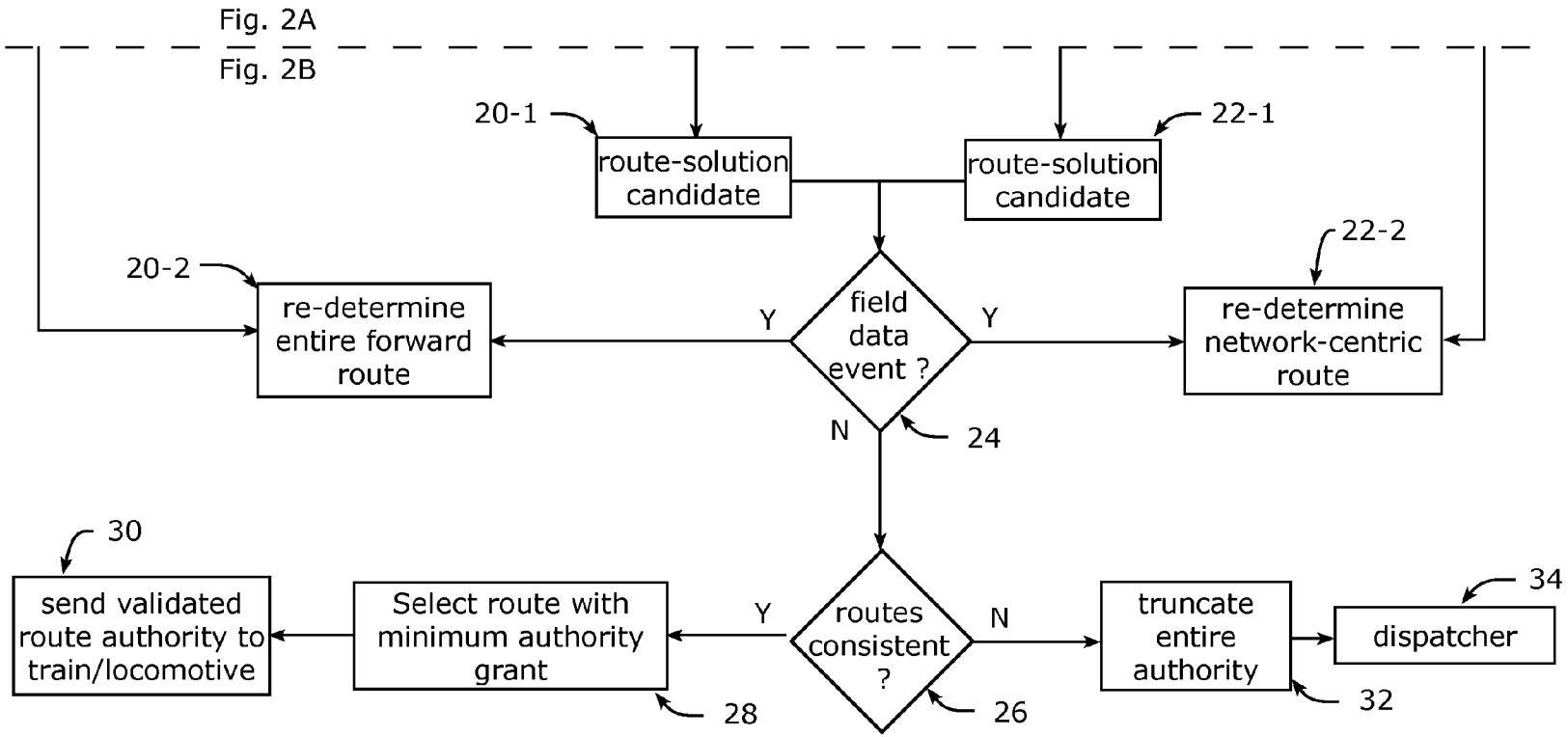

FIGS. 2A-B illustrates an overall process diagram or flow chart of the preferred dual-process system, generally indicated by the reference character 10. As shown in FIG. 2A, the system includes a communications server 12 and an authority server 18 in which the independent object process 20 and the network-centric process 22 are implemented. The organization of the system 10 is representative only, since other organizations and arrangements are equally suitable.

The communications server 12 accepts input information as to the route endpoints and times and, optionally, one or more mid-points via interface 14; this information is typically provided by a dispatcher. Additionally, the communications server 12 accepts field data information via the interface 16; that information can include periodic locomotive/train location information, switch alignment information, track occupancy information, and all other field data necessary to effect route selection and authority conflict checking. Additionally, the communications server 12 can provide data, information, commands, etc. and feedback information to the devices/objects in the field.

Figure 3A:
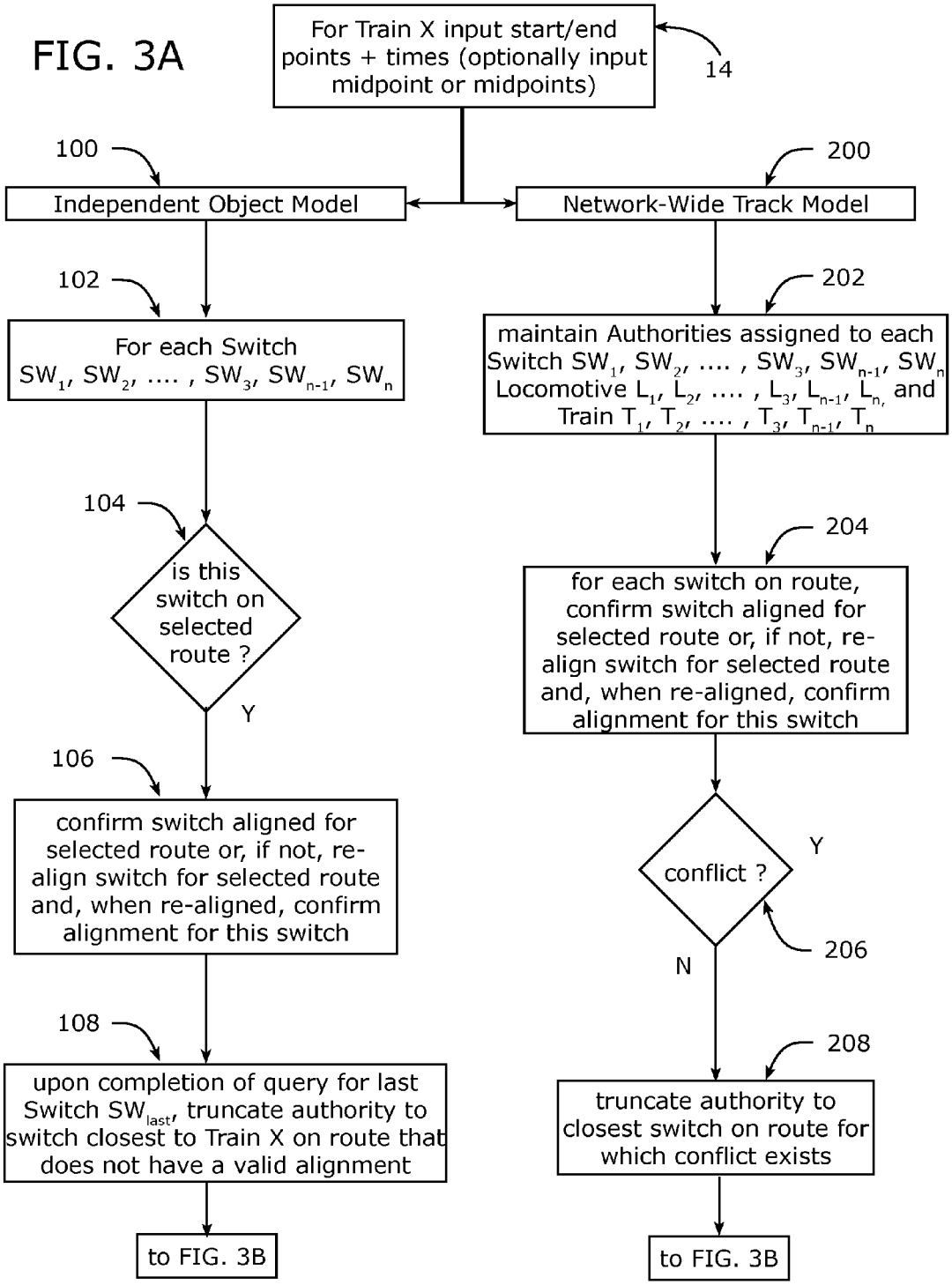
FIGS. 3A-3C are a representative example of one detailed approach to implement the system of FIG. 2.
Figure 3B:
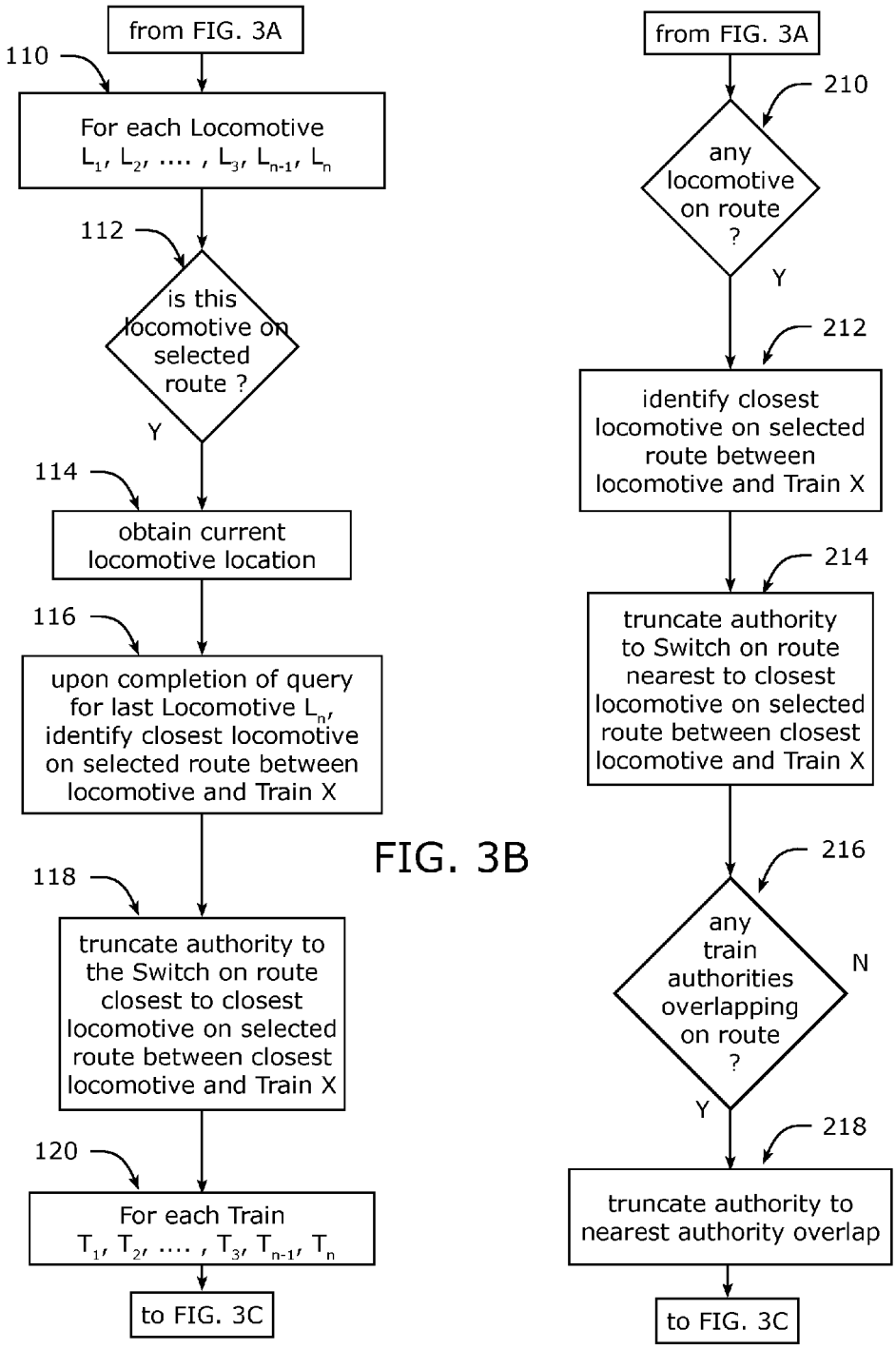
Figure 3C:
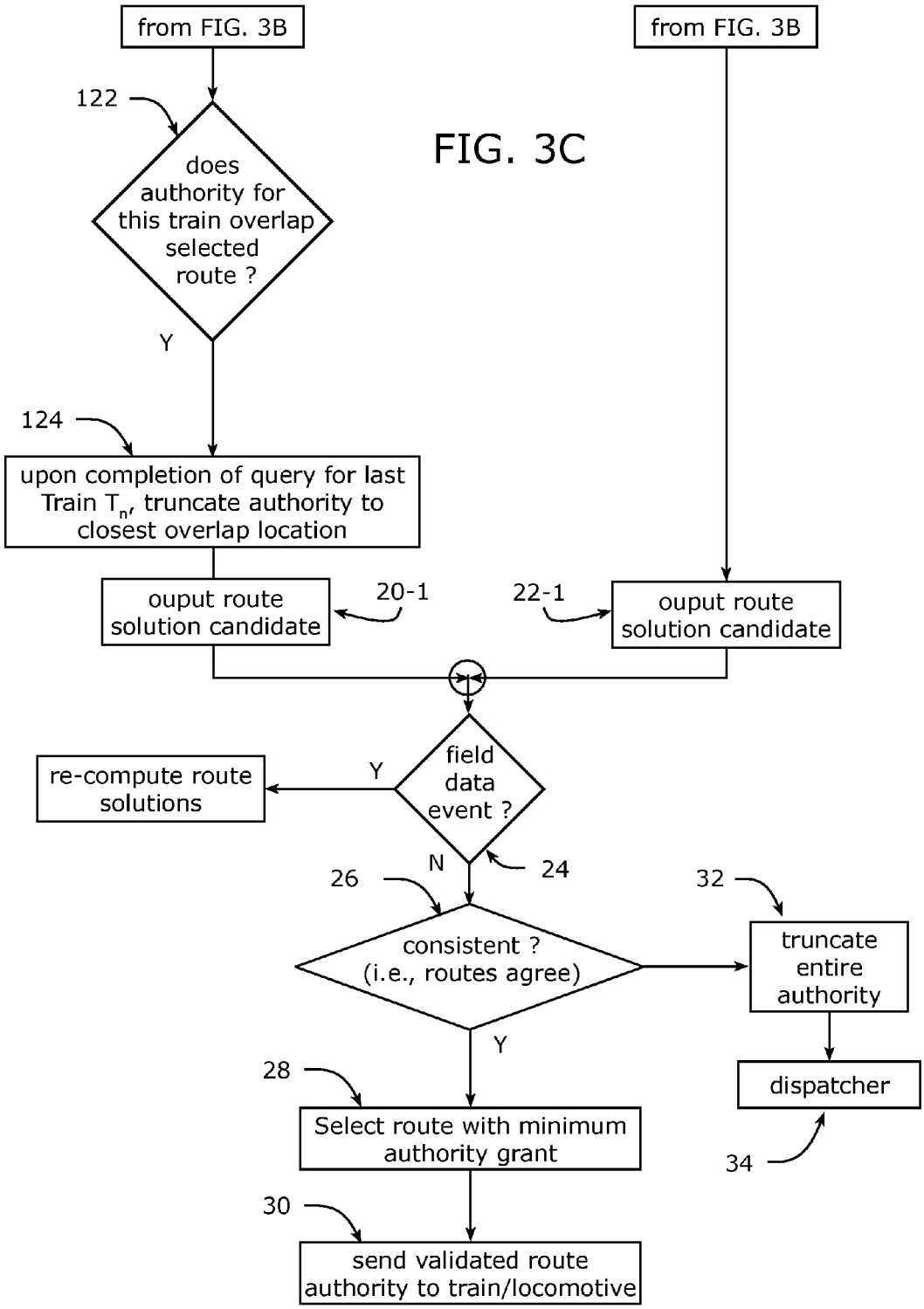

The authority server 18, which can be independent of or an integrated part of the central office server (not shown), includes at least two independent routing processes that utilize the field data provided through the field data interface 16; typically the authority server 18 is a general or special purpose computer with appropriate programming as summarized in FIGS. 3A-3C.

As shown, the authority server 18 includes an Independent Object Process 20 and a Network-centric Track Monitor Process 22 and operates as a function of the field data provided via the field data interface 16 and the dispatcher-provided inputs through interface 14 as to endpoints (and, optionally, mid-points) and times.

The Independent Object process 20, the details of which are discussed in FIGS. 3A-3C, includes object-representations of devices/apparatus in the field. Thus, the Independent Object process 20 includes representations of Locomotive Objects, Switch Objects, Train Objects, Track Objects, and other objects, including, for example, open/close road crossings and open/close bridges. Each representation includes all data-attributes, operating states, and status information.

The Network-Wide Track Monitor Process 22, the details of which are also discussed in FIGS. 3A-3C, includes a database record/field structure for each device/apparatus in the field with all necessary data-attributes associated therewith and related software for route determination and authority validation. In FIG. 2A, the Network-Wide Track Monitor Process 22 includes a symbolic representation of various tracks 1 . . . M, various switches 1 . . . N, a train "A" and a locomotive "B".

The primary difference between the two processes is the Independent Object Model uses Object Oriented techniques to determine the route—each object independently maintains its own operating state or configuration and each object communicates with each other to request their respective state or configuration (not knowing any internal details) or to request a change in their state or configuration (e.g., asking a switch to change alignment). The Network-Wide Track Model uses traditional functional (structured) techniques—one master program has arrays of switches, track segments, locomotives, etc., and "knows" how to arrange them for the correct solution.

Considering a train crossing two switches in the context of (A) the Independent Object Model and (B) the Network-Wide Track Model:

(A) The Independent Object Model has the train move to the first switch and inquire as to its current state. If not aligned properly, the train requests the switch to move. If the switch does move, the train moves its location to the next switch. If the first switch did not move, the train has to stop at that point. The switch itself decides if it can move (e.g., by asking an associated track circuit if it is occupied and asking another train or trains if they have authority over it). Each object thus can run in its own process or thread.

(B) The Network-Wide Track Model has one process take the two endpoints and determines which switches are geographically between them. If there are no authorities also between those endpoints and no occupied track circuits, the switches are moved to the proper alignment. This one process "understands" all of the logic, and effectively performs the checks in reverse of the Independent Object Model.

In a software context, the Independent Object Model is preferably implemented in C++ or Ada which are well suited to collections of intelligent objects. Conversely, The Network-Wide Track Model is preferably implemented in C, better suited to arrays of data structures that functions use to perform calculations.

As shown in FIG. 2B and as discussed in more detail below, the Independent Object process 20 and the Network-Wide Track Monitor Process 22 use the common information input by the dispatcher via the interface 14 and the field data provided across the field data interface 16 to each provide a proposed route-solution candidate at steps 20-1 and 22-1 with the appropriate authorities for the process-specific route.

A query is presented at 24 as to the presence or absence of a field data event (i.e., some change in the data provided from the objects in the field); if a field data event is present, the route determining routines are repeated via pathways 20-2 and 22-2. Conversely, if no field data event is present, the two routes are checked for consistency or the absence of a conflict or conflicts at step 26. In that case where the routes are consistent, the route with the minimum authority grant is preferably selected at step 28 and sent to the train or locomotive at step 30. Conversely, where the routes are inconsistent, the entire authority is truncated at step 32 and appropriate notification is provided to the dispatcher at step 34.

FIGS. 3A-3B provide a more detail representation of the overall process/flow shown in FIGS. 2A-2B with the process/flow on the left representing the independent object model and the process/flow on the right representing the network-centric track model.

In FIG. 3A, information as to the route endpoints and times and, optionally, one or more mid-points for a Train X is input at step 14 with the so-input information presented to both the independent object model pathway 100 and the network-centric track model 200.

As shown on the left in FIG. 3A, the independent object model pathway 100 can be sub-divided into three sub-processes including a sub-process for identifying that switch closest to the Train X that does not have a valid alignment (steps 102-108), identifying that locomotive closest to the Train X on the selected route (steps 110-118), and identifying that train closest to the Train X on the selected route for which an overlapping authorities exits (steps 120-124).

At steps 102-104, a determination in made for each switch $SW_1, SW_2, \ldots, SW_3, SW_{n-1}, SW_n$ as to whether or not that switch is on the proposed route. For that sub-set of switches on the proposed route and at step 106, the switch alignment is confirmed as aligned for proposed route and, if not, the switch is re-aligned and the alignment confirmed. When the determination for the last switch $SW_{last}$ is made and at step 108, the authority is truncated to the switch closest to Train X on the route that does not have a valid alignment.

At steps 110-112, a determination in made for each locomotive $L_1, L_2, \ldots, L_3, L_{n-1}, L_n$ as to whether or not that locomotive is on the proposed route. The current position is determined at step 114 for that sub-set of locomotives on the proposed route, and, at step 116, the locomotive on the selected route closest to Train X is identified. When closest locomotive is identified, the authority is truncated to the switch on the route closest to the closest locomotive on selected route between Train X and the closest locomotive.

At steps 120-112, a determination in made for each train $T_1, T_2, \ldots, T_3, T_{n-1}, T_n$ as to whether or not that train is on the proposed route. For that sub-set of trains on the proposed route, a query is presented at step 122 regarding authority overlap with the current route. Thereafter and at step 124, the authority is truncated to the closest overlap location and the proposed route provided as a route-solution candidate at step 20-1.

As shown on the right in FIG. 3A, the network-centric track model 200 can be sub-divided into three sub-processes including a sub-process for identifying that switch closest to the Train X that does not have a valid alignment (steps 202-208), identifying that locomotive closest to the Train X on the selected route (steps 210-214), and identifying that train closest to the Train X on the selected route for which an overlapping authorities exits (steps 216-218).

At step 202, the various authorities for each Switch $SW_1, SW_2, \ldots, SW_3, SW_{n-1}, SW_n$, Locomotive $L_1, L_2, \ldots, L_3, L_{n-1}, L_n$, and Train $T_1, T_2, \ldots, T_3, T_{n-1}, T_n$ are maintained. At step 204 and for each switch $SW_1, SW_2, \ldots, SW_3, SW_{n-1}, SW_n$, on the route, the switch alignment is confirmed as aligned for the proposed route and, if not, the switch is re-aligned and the alignment confirmed. Thereafter, a query is present at step 206 as to the presence or absence of a conflict, and, if no conflict is present, the authority is truncated at step 208 to the switch closest to Train X on the route for which a conflict exists.

At step 212, the locomotive closest to train X is identified and, at step 214, the authority is truncated to the switch on the route closest to the closest locomotive on selected route between closest locomotive and Train X. At steps 216-218, a determination in made for each train $T_1, T_2, \ldots, T_3, T_{n-1}, T_n$ whether or not that train is on the proposed route and the authority truncated to the closest overlap location; thereafter, the proposed route output at step 22-1.

As shown in FIG. 3C, a field data event check is made at step 24 and, where the field data has changed, the process restarts to thereafter output re-computed route solution candidates consistent with the process/flow shown in FIGS. 2A-2B.

A consistency check is made at step 26 and where consistency is found, the route with the minimum authority grant is forward to the train/locomotive as discussed above in relationship to FIGS. 2A-2B. Where consistency is absent, the entire authority is truncated at step 32 and a notification provided to the dispatcher at step 34.

In the above, system the Network-Wide Track process and the Independent Object process can be run concurrently or sequentially or in a mixed concurrent/sequential manner. The functional process diagrams of FIGS. 2A-2B and 3A-3C can be implemented in analog or digital form (or a combination thereof) and can be implemented by discrete devices or, more preferably, as one or more firmware- or software-controlled microprocessors or microcomputers (as well as special-purpose processors, including RISC processors), application-specific integrated circuits (ASIC), programmable logic arrays (PLA), discrete logic or analog circuits, and/or combinations thereof. If desired, multi-processor parallel processing can be utilized.

The above disclosed system beneficially receives common input data and process that data via two different pathways to arrive and candidate route solutions with the better of route solutions provided to the train or locomotive.

As will be apparent to those skilled in the art, various changes and modifications may be made to the illustrated embodiment of the present invention without departing from the spirit and scope of the invention as determined in the appended claims and their legal equivalent.

The invention claimed is:

1. A dual-process system for the automatic generation of at least one movement authority solution between a start point and an end point for a locomotive or a train in a rail system, comprising:

means for accepting dispatcher-provided endpoints and time data in a rail system;

a stored-program controlled computing device executing two independent and different routing processes to provide two independently determined routing authority candidate solutions, one of said independent routing processes comprising an independent-object process and the other of said independent routing processes comprising a network-track process;

means for comparing the two candidate solutions for consistency and, when the two candidate solutions are consistent, designating the route solution with the minimum authority grants as the route solution for use by the locomotive or train.

2. The dual-process system of claim 1, wherein the independent-object process includes track objects, one or more locomotive or train objects, and switch objects.

3. The dual-process system of claim 1, wherein the network-track process interrogates at least one switch and at least one track between the endpoints for the presence of an authority.

4. A dual-process method for the automatic generation of movement authority solutions between a start point and end point for a locomotive or a train in a rail system, comprising:

accepting dispatcher-provided endpoints and time data in a rail trackway system;

executing two independent routing processes to provide two independently determined routing authority candidate solutions, one of said independent routing processes comprising an independent-object process and the other of said independent routing processes comprising a network-track process;

comparing the two candidate solutions for consistency and, when the two candidate solutions are consistent, designating the route with the minimum authority grants as the solution for use by the locomotive or train.

5. The dual-process method of claim 4, wherein the independent-object process includes track objects, one or more locomotive or train objects, and switch objects.

6. The dual-process method of claim 4, wherein the network-track process interrogates at least one switch and at least one track between the endpoints for the presence of an authority.

* * * * *